US006772970B2

(12) United States Patent
Davis et al.

(10) Patent No.: US 6,772,970 B2
(45) Date of Patent: Aug. 10, 2004

(54) GYRATORY CRUSHER SPIDER PISTON

(75) Inventors: Dale C. Davis, New Berlin, WI (US); Albert J. Van Mullem, Sussex, WI (US)

(73) Assignee: Sandvik AB, Sandviken (SE)

( * ) Notice: Subject to any disclaimer, the term of this patent is extended or adjusted under 35 U.S.C. 154(b) by 255 days.

(21) Appl. No.: 09/758,677

(22) Filed: Jan. 11, 2001

(65) Prior Publication Data

US 2002/0088887 A1 Jul. 11, 2002

(51) Int. Cl.[7] ..... B02C 2/06
(52) U.S. Cl. ..... 241/210; 241/209
(58) Field of Search ..... 241/207–216

(56) References Cited

U.S. PATENT DOCUMENTS

| | | | |
|---|---|---|---|
| 3,924,815 | A | 12/1975 | Haggren |
| 4,179,076 | A | 12/1979 | Barrot et al. |
| 4,384,684 | A | 5/1983 | Karra |
| 4,410,143 | A | 10/1983 | Polinski |
| 4,467,971 | A | 8/1984 | Schuman |
| 4,478,373 | A | 10/1984 | Gieschen |
| 4,519,551 | A | 5/1985 | Ceurvorst |
| 4,659,026 | A | 4/1987 | Krause et al. |
| 4,750,679 | A | 6/1988 | Karra et al. |
| 5,022,593 | A | 6/1991 | Stelk |
| 5,031,843 | A | 7/1991 | Motz |
| 5,080,294 | A | 1/1992 | Dean |
| 5,372,318 | A | 12/1994 | Jacobson |
| 5,769,340 | A | 6/1998 | Jean |
| 5,775,607 | A | 7/1998 | Bayliss et al. |
| 5,803,382 | A | 9/1998 | Ganser, IV et al. |
| 5,810,269 | A | 9/1998 | Shannon |
| 5,915,638 | A | 6/1999 | Jean |
| 5,934,583 | A | 8/1999 | Jean |
| 5,938,133 | A | 8/1999 | Bayliss et al. |
| 5,944,265 | A | 8/1999 | Ganser, IV et al. |
| 5,964,422 | A | 10/1999 | Ruokonen et al. |
| 5,996,916 | A | 12/1999 | Musil |
| 6,007,009 | A | 12/1999 | Sheridan et al. |

*Primary Examiner*—Mark Rosenbaum
(74) *Attorney, Agent, or Firm*—Burns, Doane, Swecker & Mathis, LLP

(57) ABSTRACT

A spider sleeve and seal apparatus for a gyratory crusher has upper and lower cylindrical sleeves disposed between the spider and a vertically slidable piston. Fixed o-rings are located between the sleeves and the spider, and moving seals are located in the piston. These seals prevent leakage from the hydraulic ring used to support the piston and shaft of the gyratory crusher.

21 Claims, 2 Drawing Sheets

GYRATORY CRUSHER SPIDER PISTON

FIELD OF THE INVENTION

The present invention relates to rock crushing systems, such as conical rock crushers or gyratory crushers. More specifically, the present invention relates to a spider piston sleeve and seal arrangement for rock crushers.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. A spider assembly rests on the top shell, forming the top of the support structure for the machine.

A shaft extends vertically through the rock crusher. The shaft is supported by a bearing in the spider assembly. The central portion of the shaft tapers inwardly in an upward direction to form the central conical crushing member. The central portion of the shaft supports the mantle, which moves with the shaft to effect the gyratory crushing operation.

The spider assembly is designed to support the shaft while allowing gyratory movement during operation of the machine. The vertical position of the shaft with respect to the spider assembly is controlled by a piston arrangement in the spider assembly. The piston arrangement is a complex mechanical apparatus including a piston, a bearing, and an attachment system. The piston is slidably disposed within the spider assembly. The bearing is supported by the piston and supports the shaft while allowing gyratory motion. The bearing has a hemispherical ball disposed in a socket; the hemispherical ball is lubricated by a lubricant, such as oil. The attachment system is required to clamp the shaft to the bearing.

The piston is supported by an annular hydraulic cushion that forces the piston to travel upward when it is filled with fluid. Because of the mass of the shaft being supported by the piston, the pressure inside the hydraulic ring is substantial. Seals are required both above and below the hydraulic cushion to prevent fluid from leaking downward into the crusher cavity or upward into the spider cavity.

Typically, cylindrical sleeves are used between the piston and spider to protect the spider from damage due to the motion of the piston. Therefore, leakage of oil from the hydraulic cushion must be prevented both between the piston and the cylindrical sleeves, and between the cylindrical sleeves and the spider. The sleeve and seal arrangements are complex with respect to the number of parts required and the difficulty of installation.

One conventional approach to the problem of sealing the hydraulic cushion has been to use an upper cylindrical sleeve that is installed from above the spider and a lower cylindrical sleeve that is installed from underneath the spider. The disadvantage to this approach is that if the lower sleeve needs to be replaced, it must be accessed from below the spider assembly, which is difficult because removal of the spider is required. Conventional sleeve arrangements also use additional rings to define the top and bottom of the oil cushion, in addition to the sleeves. The use of these rings is effective in sealing the space but not desirable because of the additional parts. A further disadvantage of conventional piston sleeve and seal arrangements is that both the lower and upper sleeves must be attached to the spider with additional hardware.

Therefore, it would be advantageous to have a piston sleeve arrangement that may be installed and replaced from above the piston, i.e., "top service". Further, there is a need for a piston sleeve and seal arrangement that requires fewer parts. Further still, there is a need for a piston sleeve and seal arrangement that does not require hardware to install the lower sleeve.

SUMMARY OF THE INVENTION

An exemplary embodiment relates to a gyratory crusher that has a shell and a spider supported by the shell. The gyratory crusher has a piston disposed within the spider, and a shaft that is coupled to the piston. An upper cylindrical sleeve having a flange is disposed between the piston and the spider. A lower cylindrical sleeve having a flange is also disposed between the piston and the spider. The lower sleeve is retained by the spider and the upper sleeve without the use of other attachment means.

Another embodiment relates to a spider sleeve apparatus for a gyratory crusher. The gyratory crusher has a piston disposed in a spider. The spider sleeve apparatus has an upper cylindrical sleeve having a flange is disposed between the piston and the spider. The spider sleeve apparatus has a lower cylindrical sleeve having a flange is disposed between the piston and the spider. The lower sleeve is retained by the spider and the upper sleeve without the use of other attachment devices.

A further embodiment relates to a method of installing or replacing lower and upper cylindrical sleeves for a gyratory crusher. The gyratory crusher has a shaft supported by a bearing. The bearing is supported by a piston disposed within a spider. The method of installing or replacing the lower and upper cylindrical sleeves includes the steps of removing the bearing, removing the piston, and installing the lower sleeve by lowering it in from above the spider. The method includes further steps of installing the upper sleeve by lowering it in from above the spider, bolting the upper sleeve to the spider. The method also includes steps of replacing the piston, and replacing the bearing.

A still further embodiment relates to a gyratory crusher having a shell and a spider supported by the shell. The gyratory crusher has a piston disposed within the spider, and a shaft coupled to the piston. An upper cylindrical sleeve with a flange is disposed between the piston and the spider. A lower cylindrical sleeve with a flange is also disposed between the piston and the spider. The gyratory crusher has a hydraulic cushion in the space defined by the lower sleeve flange, the piston, and the upper sleeve. An upper o-ring is disposed between the upper sleeve and the spider. A lower o-ring is disposed between the lower sleeve and the spider. The o-rings provide a seal for the hydraulic cushion such that the need for an additional ring seal is eliminated.

A still further embodiment relates to a spider sleeve apparatus for a gyratory crusher. The gyratory crusher has a piston disposed in a spider. The spider sleeve apparatus has upper cylindrical sleeve means having a flange disposed between the piston and the spider. The spider sleeve apparatus has lower cylindrical sleeve means having a flange disposed between the piston and the spider. The lower sleeve is retained by the spider and the upper sleeve without the use of other attachment devices.

BRIEF DESCRIPTION OF THE DRAWINGS

An exemplary embodiment will hereafter be described with reference to the accompanying drawings, wherein like reference numerals denote like elements, and.

DETAILED DESCRIPTION OF THE PREFERRED EMBODIMENTS

Figure 1:
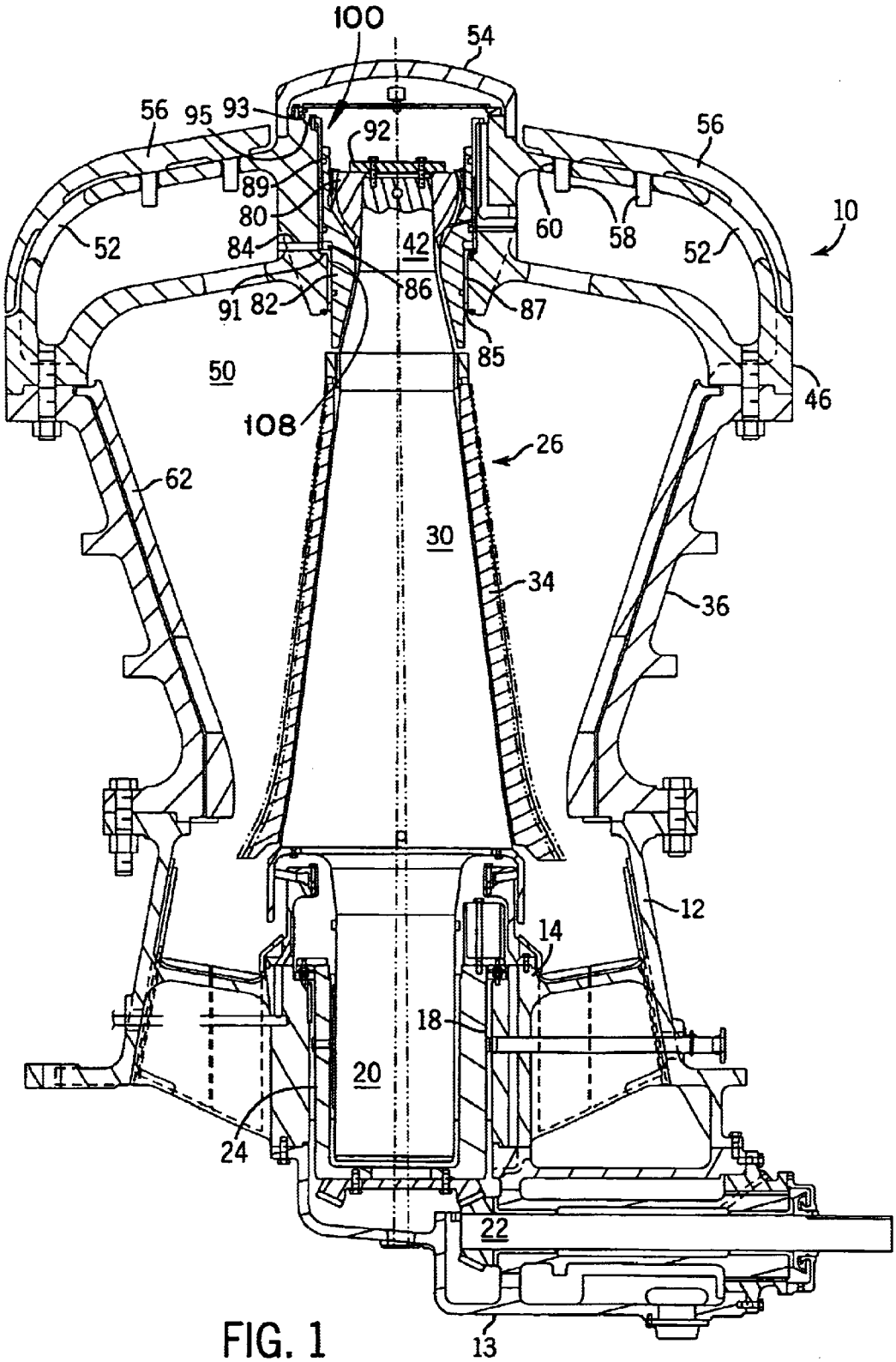
FIG. 1 is a vertical sectional view of a gyratory crusher.

Referring to FIG. 1, a gyratory crusher 10 can be utilized to crush rock, ore, minerals, waste, or other material. Gyratory crusher 10 is assembled on a cast steel base or bottom shell 12 having a central hub 14. Central hub 14 is provided with a vertical bore 18 adapted to receive a cylindrical support shaft 20. The shaft 20 varies in cross section, but extends through the machine into the spider 46. Drive housing 13 extends outwardly from hub 14 to enclose a drive mechanism 22. Drive mechanism 22 causes rotation of an eccentric 24 which directs the gyratory motion of the shaft 20.

A head assembly 26, which is part of the shaft 20, includes a head member 30 which is covered by a mantle 34. Mantle 34 provides one of the crushing surfaces of crusher 10.

A top shell 36 projects upwardly from bottom shell 12 and is covered by a spider assembly including a spider 46. Alternatively, top shell 36 and bottom shell 12 can be a single piece component. Spider 46 receives a piston 82, which houses an end 42 of shaft 20.

Top shell 36 is protected from wear by several rows of concaves 62. Concaves 62 provide the crushing surface opposing mantle 34. Spider 46 can be attached or rest upon top shell 36. Vertical positioning of shaft 20 with respect to top shell 36 adjusts the relative position of concaves 62 with respect to the mantle 34 of the head member 30, thereby adjusting the size of the crushed material exiting crusher 10.

Material to be crushed is supplied through spider 46 which includes openings for entry of the material into crushing cavity 50. A liquid flush apparatus (not shown) may be provided for spraying a liquid such as water toward the crusher cavity 50.

Spider 46 is comprised of spider arms 52 radially extending outward from the center to the rim of spider 46. A spider cap 54 sits on the top center of the spider 46. Each of the spider arms 52 is protected from falling material by a spider arm guard 56. The rim of spider 46 is protected by a rim liner (not shown), also known as a hopper liner.

Shaft 20 is supported by a bearing 80 within spider 46. The bearing 80 is disposed within piston 82 that travels vertically within spider 46 to adjust the vertical positioning of shaft 20. Piston 82 is disposed within an aperture 85 of spider 46. Piston 82 is moved by a hydraulic system. The hydraulic system includes a hydraulic fluid inlet 84, and a hydraulic fluid ring 86 that is filled to move piston 82 vertically. A bearing retainer plate 92 is used to clamp shaft 20 to bearing 80.

In a preferred embodiment, the aperture 85 that houses piston 82 has a lower portion 87, and a middle portion 89. A shelf 91 is disposed between the lower portion 87 and the middle portion 89. Aperture 85 further has an upper portion 93 and an upper shelf 95.

Figure 2:
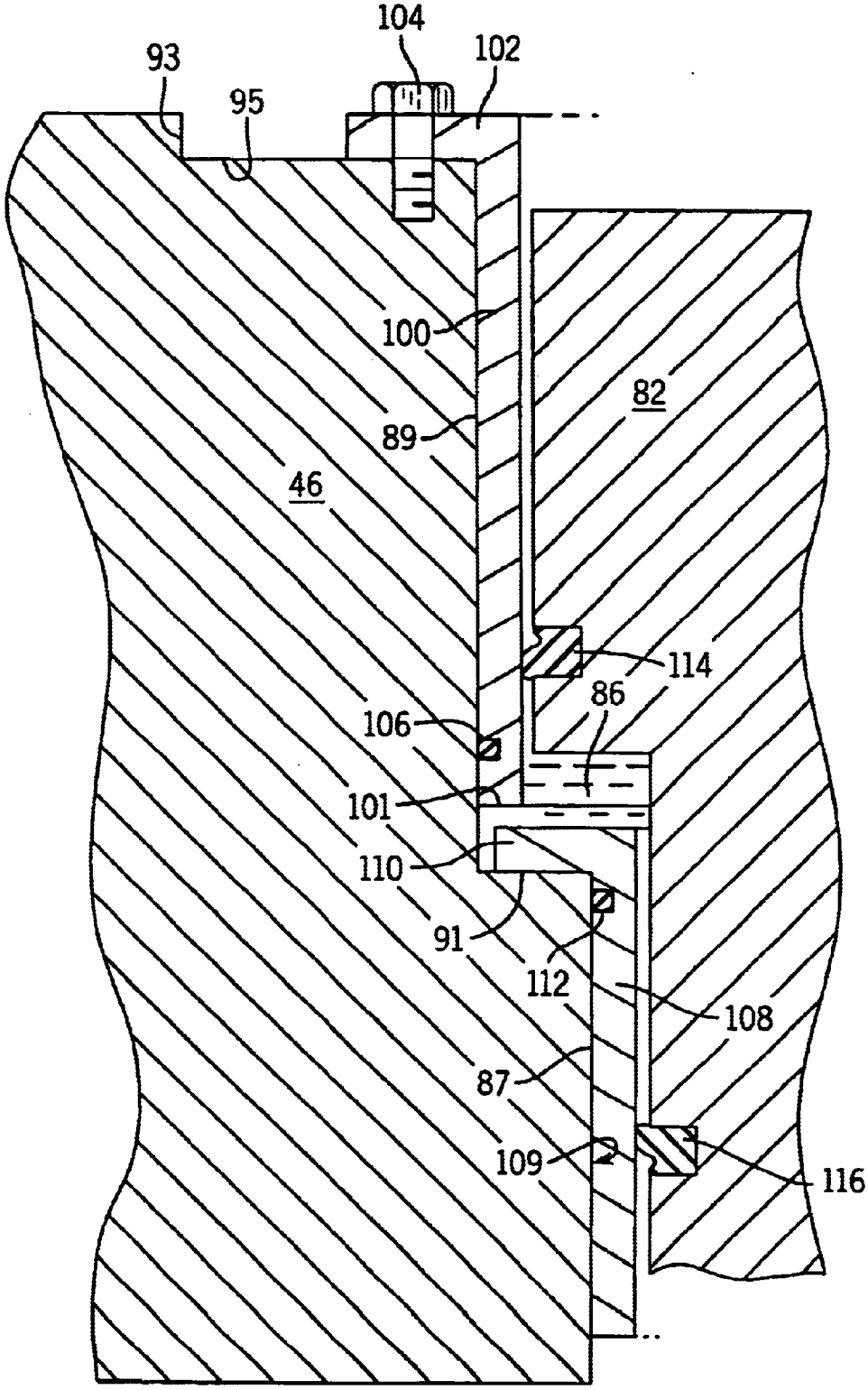
FIG. 2 is a fragmentary sectional view of a piston seal arrangement.

Referring to FIG. 2, an upper cylindrical sleeve 100 is disposed between the piston 82 and the spider 46. A lower cylindrical sleeve 108 is disposed between the piston 82 and the spider 46 below the upper sleeve 100. Sleeves 100 and 108 protect the spider 46 from damage due to the vertically slidable piston 82. Hydraulic fluid ring 86 is located between the upper sleeve 100 and lower sleeve 108 with an inner diameter of about 736 mm and an outer diameter of about 838 mm.

In a preferred embodiment, upper sleeve 100 is a cylinder made of steel. Sleeve 100 has an inner radius of 419 mm and an outer radius of 439 mm. Upper sleeve 100 has a flange 102 that is supported by spider 46 on shelf 95. The distance from the flange to the bottom of upper sleeve 100 is 685 mm in a preferred embodiment, and the flange extends 46 mm outward from upper sleeve. Eight bolts 104 thread into spider 46 and are used to secure upper sleeve 100 to shelf 95. Bolts 104 are M20×80.

An o-ring 106 is disposed between upper sleeve 100 and spider 46. Preferably, the o-ring 106 is located about 50 mm above bottom 101 of sleeve 100. O-ring 106 is made of rubber, and is fixed in place because sleeve 100 and spider 46 do not move relative to each other.

In a preferred embodiment, lower sleeve 108 is made of steel and has an inner radius of 368 mm and an outer radius of 389 mm. Lower sleeve 108 has an outwardly extending flange 110, that extends 43 mm from sleeve 108. Flange 110 rests on lower shelf 91. In a preferred embodiment, sleeve 108 extends 273 mm from flange 110 to the lower end of the sleeve.

O-ring 112 is preferably made of rubber and is located about 25 mm below flange 110 between sleeve 108 and spider 46. O-ring 112 prevents flow of oil from hydraulic ring 86 downward between spider 46 and sleeve 108. O-ring 112 is fixed in position between sleeve 108 and spider 46. Sleeve 108 requires no attachment hardware because it is captive between spider 46 and upper sleeve 100.

Lower sleeve 108 is captive for the following reasons. Flange 110 rests on shelf 91 preventing lower sleeve 108 from moving downward. Outer surface 109 with a diameter of 389 mm is flush against lower portion 87 of spider 46 preventing movement of cylinder 108 in a horizontal direction. Sleeve 108 is prevented from moving upward by upper cylinder 100 because flange 110 would make contact with lower surface 101 of upper sleeve 100. Thus, lower sleeve 108 requires no attachment devices. A dowel is used to prevent rotation of the lower sleeve 108.

Piston 82 has two moving seals 114 and 116 to prevent leakage from hydraulic fluid ring 86. Typical moving seals are polyurethane and rubber Parker Polypak seals. The range of motion of piston 82 is 240 mm in a preferred embodiment. Lower moving seal 116 is always disposed between piston 82 and lower sleeve 108. Upper moving seal 116 is always disposed between piston 82 and upper sleeve 100.

Because the oil in hydraulic fluid ring 86 supports the piston 82 and shaft 20, it is under pressure. In a preferred embodiment, the pressure in hydraulic fluid ring 86 is 300-2000 psi. Therefore, seals 106, 112, 114, and 116 are designed to withstand 5000 psi to prevent leakage from hydraulic fluid ring 86. In a preferred embodiment, the oil used in hydraulic fluid ring 86 is ISO grade 68.

To install the sleeve and seal system, bearing 80 and piston 82 must be removed from the spider 46. The bearing 80 and piston 82 can be removed through the top of spider 46 after bearing retainer plate 92 is detached from shaft 20. Once piston 82 and bearing 80 have been removed, the upper cylindrical sleeve 100 and lower cylindrical sleeve 108 are accessible from the top of spider 46. Bolts 104 of upper sleeve 100 are removed so that upper sleeve 100 may be removed through top of spider 46. Lower sleeve 108 may then be lifted out through top of spider 46.

The present sleeve and seal arrangement has several advantages over conventional piston sleeves and seals. The first advantage is top service. The sleeves and seals in the present invention may be installed through the top of spider 46. This is an advantage because the area underneath spider 46 is not as accessible for maintenance and installation purposes. Conventionally, the shaft 20 or spider 46 need to be removed for access. Therefore, top service reduces the time and cost of maintenance on a gyratory crusher 10. Secondly, the seal and sleeve arrangement requires fewer parts than conventional sealing arrangements. There are no separate retainers that must be bolted in to seal the hydraulic space 86. Upper sleeve 100 and lower sleeve 108, in combination with o-rings 106 and 112 and moving seals 114 and 116, seal the hydraulic ring 86 adequately without additional rings. Thirdly, the present invention does not require hardware for installation of the lower cylindrical sleeve 108. This is because the lower sleeve 108 is held captive by upper sleeve 100 and spider 46. This reduction in hardware reduces maintenance costs.

Gyratory crusher 10 operates as follows. When the drive mechanism 22 is driven by any appropriate means, mechanism 22 transmits power to the eccentric 24. Eccentric 24 causes the gyration of the head assembly 26, resulting in the crushing of the material in the crushing chamber 50. The phantom lines flanking the mantle 34 and shaft 20 axis on FIG. 1 indicate the range of gyratory motion.

While several embodiments of the invention have been described, it should be apparent to those skilled in the art that what has been described is considered at present to be the preferred embodiments of a spider piston sleeve and seal arrangement. However, in accordance with the patent statutes, changes may be made in the design without actually departing from the true spirit and scope of this invention. The following claims are intended to cover all such changes and modifications which fall within the true spirit and scope of this invention.

What is claimed is:

1. A gyratory crusher, comprising:

a shell;

a spider supported by the shell;

a piston disposed within the spider;

a shaft coupled to the piston;

an upper cylindrical sleeve disposed between the piston and the spider, the upper sleeve having a first flange; and a lower cylindrical sleeve disposed between the piston and the spider, the lower sleeve having a second flange;

wherein the lower sleeve is retained by the spider and the upper sleeve without the use of other attachment means.

2. The gyratory crusher of claim 1, further comprising:

an upper O-ring disposed between the upper sleeve and the spider; and a lower O-ring disposed between the lower sleeve and the spider.

3. The gyratory crusher of claim 2, wherein the O-rings remain intact at a hydraulic pressure of 5000 psi.

4. The gyratory crusher of claim 1, wherein the upper sleeve has an inner diameter of about 840 mm and an outer diameter of about 880 mm.

5. The gyratory crusher of claim 1, wherein the lower sleeve has an inner diameter of about 740 mm and an outer diameter of about 780 mm.

6. The gyratory crusher of claim 1, further comprising:

a first moving seal coupled to the piston and the upper sleeve, and a second moving seal coupled to the piston and the lower sleeve.

7. A gyratory crusher comprising a piston disposed in a spider, and a sleeve apparatus comprising:

an upper cylindrical sleeve disposed between the piston and the spider, the upper sleeve having a first flange; and a lower cylindrical sleeve disposed between the piston and the spider, the lower sleeve having a second flange;

wherein the lower sleeve is retained by the spider and the upper sleeve without the use of other attachment devices.

8. The gyratory crusher of claim 7, further comprising:

an upper O-ring disposed between the upper sleeve and the spider; and a lower O-ring disposed between the lower sleeve and the spider.

9. The gyratory crusher of claim 8, wherein the O-rings remain intact at a hydraulic pressure of 5000 psi.

10. The gyratory crusher of claim 7, wherein the upper sleeve has an inner diameter of about 840 mm and an outer diameter of about 880 mm.

11. The gyratory crusher of claim 7, wherein the lower an inner diameter of about 740 mm and an outer diameter of about 780 mm.

12. The gyratory crusher of claim 7, further comprising:

a first moving seal coupled to the piston and the upper sleeve, and a second moving seal coupled to the piston and the lower sleeve.

13. A gyratory crusher, comprising:

a shell;

a spider supported by the shell;

a piston disposed within the spider;

a shaft coupled to the piston;

an upper cylindrical sleeve disposed between the piston and the upper sleeve having a first flange;

a lower cylindrical sleeve disposed between the piston and the lower sleeve having a second flange;

a hydraulic cushion in a space defined by the lower sleeve piston, and the upper sleeve;

an upper O-ring disposed between the upper sleeve and the spider; and a lower O-ring disposed between the lower sleeve and the spider;

whereby the O-rings provide a seal for the hydraulic cushion such that the need for an additional ring seal is eliminated.

14. The gyratory crusher of claim 13, wherein the upper sleeve has an inner diameter of about 840 mm and an outer diameter of about 880 mm.

15. The gyratory crusher of claim 13, wherein the lower sleeve diameter of about 740 mm and an outer diameter of about 780 mm.

16. The gyratory crusher of claim 13, further comprising:

a first moving seal coupled to the piston and the upper sleeve, and a second moving seal coupled to the piston and the tower sleeve.

17. The gyratory crusher of claim 13, wherein the O-rings remain intact at a hydraulic pressure of 5000 psi.

18. A gyratory crusher comprising a piston disposed in a spider, and a sleeve apparatus comprising:

upper cylindrical sleeve means disposed between the piston and the spider, the upper sleeve means having a first flange; and lower cylindrical sleeve means disposed between the piston and the spider, the lower sleeve means having a second flange;

wherein the lower sleeve is retained by the spider and the upper sleeve without the use of other attachment devices.

19. The gyratory crusher claim 18, further comprising:

an upper O-ring disposed between the upper sleeve means and the spider; and a lower O-ring disposed between the lower sleeve means and the spider.

20. The gyratory crusher of claim 18, wherein the upper sleeve means is a cylinder with an inner diameter of about 840 mm and an outer diameter of about 880 mm.

21. The gyratory crusher of claim 18, wherein the lower sleeve means is a cylinder with an inner diameter of about 740 mm and an outer diameter of about 780 mm.

* * * * *